United States Patent [19]

Mecke et al.

[11] Patent Number: 4,675,063

[45] Date of Patent: Jun. 23, 1987

[54] PROCESS FOR MANUFACTURING THERMOCOLOR RIBBON

[75] Inventors: Norbert Mecke, Hanover; Heinrich Krauter, Neustadt; Wieland Kuchenreuther, Isernhagen, all of Fed. Rep. of Germany

[73] Assignee: Pelikan Aktiengesellschaft, Hanover, Fed. Rep. of Germany

[21] Appl. No.: 783,843

[22] Filed: Oct. 3, 1985

Related U.S. Application Data

[62] Division of Ser. No. 635,818, Jul. 30, 1984, Pat. No. 4,592,945.

[30] Foreign Application Priority Data

Aug. 11, 1983 [DE] Fed. Rep. of Germany ..... 3328990

[51] Int. Cl.[4] ..... B44C 1/16; B44C 1/165; B41M 5/26

[52] U.S. Cl. ..... 156/234; 156/230; 156/235; 400/120; 400/241.1; 428/195; 428/207; 428/914

[58] Field of Search ..... 156/230, 238, 239, 241, 156/289, 249, 234, 235, 90, 344; 428/914, 195, 336, 484, 327, 488.4; 427/488.1, 152, 153, 208.2; 400/120, 241.1, 241.4

[56] References Cited

U.S. PATENT DOCUMENTS

| | | | |
|---|---|---|---|
| 2,628,929 | 2/1953 | Persoon et al. | 156/238 |
| 3,035,936 | 5/1962 | Roulstou | 428/488.4 |
| 3,131,080 | 4/1964 | Russell | 428/488.1 |
| 3,620,872 | 11/1971 | Backwell | 156/238 |
| 3,628,979 | 12/1971 | Newman | 428/327 |
| 3,630,802 | 12/1971 | Dettling | 156/238 |
| 4,336,767 | 6/1982 | Wada | 428/213 |
| 4,465,389 | 8/1984 | Knirsch et al. | 428/914 |

*Primary Examiner*—David Simmons
*Assistant Examiner*—Louis Falasco
*Attorney, Agent, or Firm*—Karl F. Ross; Herbert Dubno

[57] ABSTRACT

A thermocolor ribbon comprises a plastic support foil, a fusible color layer attached to one side of the plastic support foil and an organic coating layer covering the other side of the plastic support foil. The organic coating layer is composed of a nonfibrous, pressure-stable wax or waxlike substance. A process for making the thermocolor ribbon from a plastic support foil having a fusible color layer thereon comprises application of a solution containing an organic coating material to the side of the foil not having the fusible color layer bonded thereto, followed by solvent evaporation. Alternatively, the side of the support foil bearing the fusible color is brought into intimate contact with opposite side of the foil whereupon the latter is heated for a time sufficient for transport of material from the fusible color layer to the uncoated side of the foil to form the organic coating layer thereon.

7 Claims, 2 Drawing Figures

PROCESS FOR MANUFACTURING THERMOCOLOR RIBBON

This application is a division of application Ser. No. 635,818 filed July 30, 1984, now U.S. Pat. No. 4,592,945.

FIELD OF THE INVENTION

Our present invention relates to a thermally activable image transfer ribbon, i.e. a thermocolor ribbon, and especially thermocarbon ribbons, comprising a plastic support foil with a heat-sensitive coloring layer coated thereon.

BACKGROUND OF THE INVENTION

Thermocolor ribbons known in the prior art comprise a support foil of paper, plastic or the like having a fusible color layer coating at least a portion of one side of the support foil. The fusible color layer may include a wax-bound coloring or carbon-containing substance (pigment).

Thermocolor ribbons are used in thermal printing processes in which a heated printer head presses the thermocolor ribbon to a paper transferring the character or design on the printer head to the paper. Examples of thermal printers or printing processes can be found, for example, in German Pat. Nos. 2,062,494, 2,406,613 and 3,224,445.

More specifically, thermocolor ribbons function in thermal printing devices as follows: A heated printer head is pressed against a thermocolor ribbon and a paper. The thermocolor ribbon's uncoated side comes into direct contact with the heated printer head on which raised print symbols or designs are found and its coated side contacts the paper. During the printing proces there is no relative motion of the paper with respect to the thermocolor ribbon so that the printer head which is heated to temperatures of around 400° C. melts or softens a part of the fusible color layer forming the desired print character or design. The softened or melted part of the color layer forming the desired print is transferred to the paper on contact between the thermocolor ribbons and the paper during the printing process. The thermocolor ribbon is removed from the paper or other substrate generally by a take-up spool following the actual transfer of color by adhesion. Unfortunately print characters obtained using the thermocolor ribbons of the prior art lack the sharpness and definition required of printed characters. Furthermore, smearing may occur during the printing process. Also the printing apparatus may become jammed-up by accumulation of unwanted residues from the thermocolor ribbon.

OBJECTS OF THE INVENTION

It is the object of our invention to provide an improved thermocolor ribbon whose use in a thermal printing process results in printed characters which meet the printers' requirements for sharp, well-defined print characters.

It is also an object of this invention to provide an improved thermocolor ribbon whose use in a thermal printing process produces printed characters of improved clarity and sharpness without smearing.

It is further an object of this invention to provide an improved thermocolor ribbon which reduces jam-ups of the printing apparatus.

It is yet another object of this invention to provide an inexpensive and convenient process for the manufacture of the novel thermocolor ribbon of this invention.

SUMMARY OF THE INVENTION

Our invention accordingly resides in the following, that on the side of the plastic support foil not coated by a melt-applied fusible color layer an organic coating layer is formed. The organic coating layer is composed of a wax, waxlike substance or a fluid, which wets the plastic foil, is nonfibrous (nonropy) does not decompose under applied pressure and has properties similar to those of a melted wax.

For the purpose of this invention any plastic foil may be employed which is suitable as a support for a common typewriter ribbon or which will stand the momentarily-attained high temperatures of the printing process, or which liberates the waxbound color layer when heated without undesirable side effects. Particularly the plastic foil may be a thermoplastic foil. Among the most preferred plastic support foil materials are polyesters, especially polyethylene terepthalate, polycarbonate, polyamide, blended polyvinyl polymers, such as polyvinylchloride, polyvinylacetate, polyvinylalcohol, polyvinylethylene, polypropylene, and polystyrene.

According to the practice of the invention a plastic laminate or any layer foil may be used instead of a single plastic support foil layer. Also a plasticizer may be incorporated in the plastic support foil to provide an increased flexibility. A substance having a high heat conductivity can also be advantageously worked into the plastic suport foil. The thickness of the above-described support foil will be determined by practical considerations, however the usual foil is thin, for example between 3 to 6 microns to obtain optimal surface heat transfer. These thickness limits are however not critical to the practice of this invention.

The melt-applied fusible color layer may also be composed of a wax or waxlike substance and also may include a pigment and/or other additives. Preferred pigment materials include carbon black, fast-color pigments and wax-soluble pigments.

Examples of waxlike materials suitable for the organic coating layer and the fusible color layer include paraffin waxes, silicones, natural waxes such as bees wax, carnauba wax, and ozocerite. Synthetic waxes are also suitable, especially acid waxes, ester waxes, partially saponified ester waxes, and polyethylene waxes. Other suitable materials include glycol, polyglycol and tensides (surface active agents) such as ethoxylated nonylphenols.

For the purpose of this invention a waxlike material is characterized as a material having the following properties: not plastic at 20° C. but firm to brittle; fine to coarse crystalline, translucent to opaque but not glassy; can be heated over 40° C. without decomposition but softens until its viscosity is about half that of the melt; and not ropy or stringy.

The coating layers of this invention may be advantageously formed by a variety of techniques. For example they can be formed from the melt, directly from the solvent in a press, by copper plate printing rotogravure, by other printing methods, brush application of a solution or emulsion or deposition methods.

Among the various processes for forming the layers or coatings of this invention there were two such processes that were found to be suitable for forming the thin layers of this invention, especially those no more than a micron thick. First the coating material can be dissolved in an organic solvent or can be emulsified, e.g. with water, and applied to the surface to be coated and the solvent subsequently evaporated. Suitable solvents include benzene, toluene, gasoline and zylene. The concentration of the dissolved material can be adjusted to obtain the desired surface coverages and is typically from 0.10 to 2 weight %. The solution or emulsion may be applied by flexible pressing techniques, roller applicator or a brush.

An organic coating layer having a thickness of that of a monolayer to about one micron has especially advantageous properties. A thermocolor ribbon having such a coating layer may be produced in a process which starts with a plastic support foil having a fusible color layer on one side thereof which contains the smallest possible concentration of an adhesive additive. Advantageously this adhesive additive is present in concentrations between 0.50% and 10%. First the uncoated side of the plastic support foil is brought into contact with the fusible color layer, for example by rolling about a spool or roller. Then heat is applied at a temperature and for a time sufficient to cause a transport of material from the fusible color layer to the uncoated side of the plastic support foil. For the materials of this invention temperatures of from 40° C. to 60° C. are preferred and heating times of more than four hours are effective. The transferred organic coating layer is naturally very thin and gives the desired properties to the novel thermocolor ribbon of this invention.

This invention has the following particular advantages: that the improved thermocolor ribbon can be manufactured by a convenient process that its use in a thermal printing process results in a printing style of improved clarity and sharpness, and that occasional jam-ups of the thermocolor ribbon can be reduced. Deposits on the print head are also precluded.

BRIEF DESCRIPTION OF THE DRAWING

The objects, features and advantages of this invention will be made more readily apparent from the following detailed description, reference being made to the accompanying drawing wherein.

SPECIFIC DESCRIPTION

Figure 1:
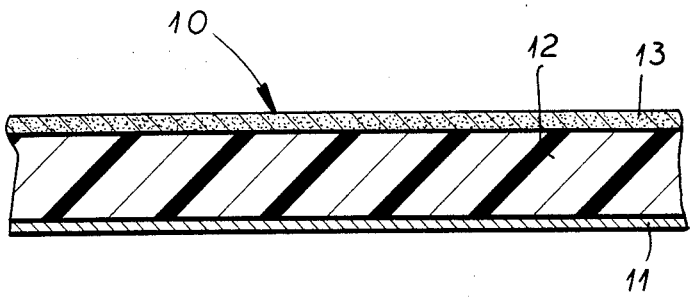
FIG. 1 is a cross section of the novel thermocolor ribbon of this invention.

FIG. 1 shows a particular embodiment of the novel thermocolor ribbon 10 of this invention comprising a plastic support foil 12 having a fusible color layer 13 at least partially coating one side thereof and an organic coating layer 11 attached to the side of the plastic support foil 12 not having fusible color layer 13 bonded thereto.

Organic coating layer 11, the primary novel feature of the invention, is a wax, waxlike material or a fluid which wets the plastic support foil whose properties are similar to those of a melted wax and is nonropy, nonstringy or nonthready and does not decompose under applied pressure.

Figure 2:
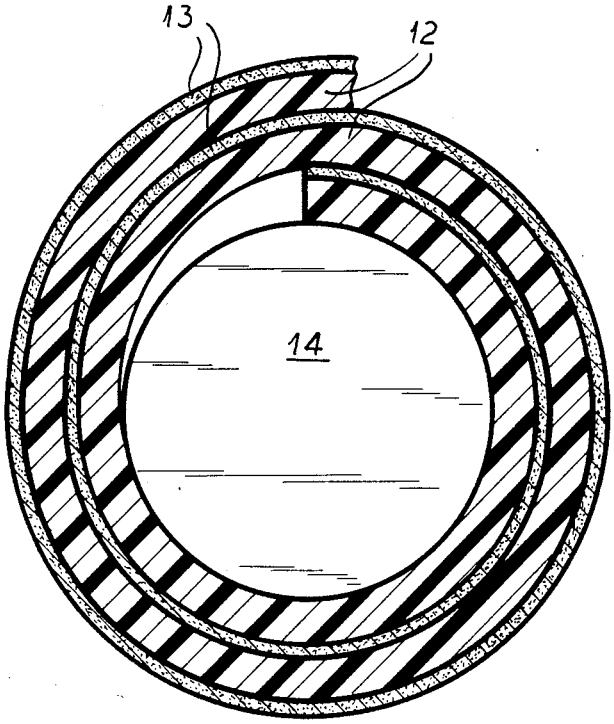
FIG. 2 shows a rolled thermocolor ribbon being formed by a particularly advantageous manufacturing process.

In FIG. 2 a stage in a process for manufacturing the thermocolor ribbon 10 of this invention is shown. In this particular process a plastic support foil 12 is first coated with an organic coating material including 0.5% to 10% by weight of an adhesive additive to form a fusible color layer 13. The organic coating layer 11 of FIG. 1 is formed by bringing the fusible color layer 13 into contact with the uncoated side of the plastic support foil 12 by coiling the ribbon about roller or spool 14 and heating for a time sufficiently long to allow transport of organic layer material to the uncoatd side of the plastic foil 12.

SPECIFIC EMBODIMENTS OF THE INVENTION

Example 1 an 8-micron-thick polyethylene terephthalate support foil will be coated on one side with the following mixture:

| | |
|---|---|
| Carnauba wax | 42.5% |
| Paraffin wax | 31.5% |
| Carbon Black | 20.0% |
| Mineral oil | 6.% |
| | 100% |

until a surface coverage of 3 g/m$^2$ is attained. On the other side of the plastic support foil a mixture of 2% by weight of an ester wax in gasoline is applied until a surface coverage of 0.050 g/m$^2$ is attained, thus forming the organic coating layer. The resulting thermocolor ribbon is easily handled. Excellent print definition and clarity are obtained when it is used in a thermal printing process.

Example 2

An 8-micron-thick polyethylene terephthalate support foil will be coated on one side with the following mixture:

| | |
|---|---|
| Carnauba wax | 41.5% |
| Paraffin wax | 30.6% |
| Carbon Black | 19.6% |
| Mineral oil | 5.9% |
| polyhydroxyethylated Sorbitan | 2.4% |
| | 100% |

until a surface coverage of 3 g/m$^2$ results. This coated support foil will be coiled about a spool or roller bringing the coated layer of the plastic foil into intimate contact with the uncoated layer. The coiled thermocolor ribbon is heated at 50° C., causing a transport of material from the coated side of the plastic support foil to the uncoated side to form an organic coating layer. After heating for two hours the resulting organic coating layer is not of a uniform thickness and the print obtained from the ribbon is smeared. An acceptable print is obtained from the thermocolor ribbon formed as described in this example if the coiled ribbon is heated for four hours or more. Excellent results are obtained for ribbons heated eight hours.

Example 3

(Comparative Example)

An 8-micron-thick polyethylene terephthalate support foil will be coated on one side with the following mixture:

| | |
|---|---|
| Carnauba wax | 42.5% |
| Paraffin wax | 31.5% |
| Carbon Black | 20.0% |

-continued

| | |
|---|---|
| Mineral oil | 6.0% |
| | 100.% |

until a surface coverage of 3 g/m$^2$ is attained. Thermocolor ribbons formed in this way were rolled about a spool or roller according to the method of example 2 and were examined with and without heating at 50° C. for eight hours. Without heating at 50° C. for eight hours the print formed from the thermocolor ribbons shows much smearing and is of poor quality. With heating at 50° C. for eight hours there is no significant improvement in printing characteristics for materials of the chemical composition described in this example.

We claim:

1. A process for the production of an image-transfer ribbon in the form of a thermocolor ribbon having a plastic support foil provided on one side with a fusible color layer from which thermal image transfer is to be effected and upon an opposite side with a coating enhancing print clarity and reducing jamups with the ribbon, said method comprising the steps of:

providing on one side of said support said fusible color layer with a material adapted to form said coating;

coiling said foil with said fusible color layer provided on one side thereof about a spool or roller so that the fusible color coating directly contacts said opposite uncoated side of said foil in at least one turn of a coil; and heating said coil at a temperature and for a period sufficient to effect thermal transfer of an amount of said material sufficient to apply said coating adherently to said opposite side of said foil in a thickness ranging from a monomolecular layer thickness to about 1 micron.

2. A process according to claim 1 wherein said plastic support foil comprises a polyethylene terephthalate film, said fusible color layer is a mixture of a carnauba wax, a paraffin wax, carbon black, and mineral oil and said thermocolor ribbon is heated for more than four hours at temperatures from 40° C. to 60° C.

3. A process according to claim 2 wherein said fusible color layer contains 0.5% to 10% by weight of an adhesive additive.

4. A process according to claim 1 wherein said material is selected from the group of natural waxes consisting of paraffin wax, carnauba wax, beeswax and ozocerite.

5. A process according to claim 1 wherein said material is selected from the group of synthetic waxes consisting of acid waxes, ester waxes, partially saponified ester waxes, polyethylene waxes and a phenolic plastic material.

6. A proces according to claim 1 wherein said material is a glycol or a polyglycol.

7. A process according to claim 3 wherein said adhesive additive is polyhydroxylated Sorbitan.

* * * * *